US006206231B1

(12) United States Patent
Laughton

(10) Patent No.: US 6,206,231 B1
(45) Date of Patent: Mar. 27, 2001

(54) WASTE CAN COVER

(75) Inventor: Scot Laughton, Toronto (CA)

(73) Assignee: Umbra, Inc., Buffalo, NY (US)

( * ) Notice: Subject to any disclaimer, the term of this patent is extended or adjusted under 35 U.S.C. 154(b) by 0 days.

(21) Appl. No.: 09/482,709

(22) Filed: Jan. 13, 2000

(51) Int. Cl.[7] ..... B65D 43/00
(52) U.S. Cl. ..... 220/827; 220/825; 220/908
(58) Field of Search ..... 220/827, 829, 220/830, 836, 825, 908

(56) References Cited

U.S. PATENT DOCUMENTS 1,810,019 * 6/1931 Jaworsky ..... 220/825 X
1,989,142 * 1/1935 Levy ..... 220/825 X
2,800,244 * 7/1957 Witt ..... 220/825 X
3,127,052 3/1964 Mayers .
3,342,368 * 9/1967 Matry ..... 220/825 X
3,749,274 * 7/1973 Mele ..... 220/825
3,989,162 11/1976 Hodge et al. .
4,649,813 3/1987 Kehl .
4,776,478 10/1988 Miller et al. .
6,065,626 * 5/2000 Huang et al. ..... 220/829 X

* cited by examiner

*Primary Examiner*—Steven Pollard
(74) *Attorney, Agent, or Firm*—Saidman DesignLaw Group

(57) ABSTRACT

A cover for a waste can has three elements: a collar; a lid; and a spring link, so-named because it functions both as a linkage between the collar and the lid and a spring for biasing the lid closed. Three modes of operation are made possible by the location of a pair of parallel pivot axes, one between the lid and the spring link and the other between the spring link and the collar. The collar is friction fit on any suitably sized receptacle.

20 Claims, 9 Drawing Sheets

WASTE CAN COVER

BACKGROUND OF THE INVENTION

1. Field of the Invention

This invention relates to a cover for a waste can, and more particularly a cover for a waste can which is capable of three modes of operation for opening the waste can, to wit: (1) backward tilt; (2) backward tilt with lock; and (3) forward tilt.

2. Description of Related Art

Waste can covers are traditionally used to cover waste cans until access thereto is desired, at which time they are opened to allow trash to be thrown therein. Closed lids prevent accidental entry of non-trash therein, prevent accidental removal of trash therefrom, and they aid in keeping any unpleasant odors from escaping into the room. Open lids allow ingress thereto for trash. Some covers, like garbage can covers, are of a single piece and must be totally removed from their garbage cans to open the cans. Other covers, like household waste can tilt-lid types, include lids which are temporarily opened to allow access to the interior of the waste can and are returned automatically to the closed position either by a spring or by gravitational forces.

The prior art is replete with waste can covers. The closest known representative samples include U.S. Pat. No. 3,127,052 to Mayers, U.S. Pat. No. 3,989.162 to Hodge el al., U.S. Pat. No. 4,649,813 to Kehl, and U.S. Pat. No. 4,776,478 to Miller et al.

OBJECTS AND SUMMARY OF THE INVENTION

It is an object of the invention to provide a cover for a receptacle that is easily removable to allow replacement of a liner.

It is a further object of the invention to provide a cover for a receptacle in which the lid of the cover closes automatically after use.

It is a further object of the invention to provide a cover for a receptacle that can be selectively locked open if desired.

It is a further object of the invention to provide a cover for a receptacle that can be opened by depressing either the front or the back of the lid.

It is a further object of the invention to provide a cover for a receptacle that comprises a minimal number of elements that are economical to manufacture.

These and other objects of the invention are achieved by means of a cover comprising only three elements: a collar; a lid; and a spring link, so-named because it functions both as a linkage between the collar and the lid and a spring for biasing the lid closed. Three modes of operation are made possible by the location of a pair of parallel pivot axes, one between the lid and the spring link and the other between the spring link and the collar.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
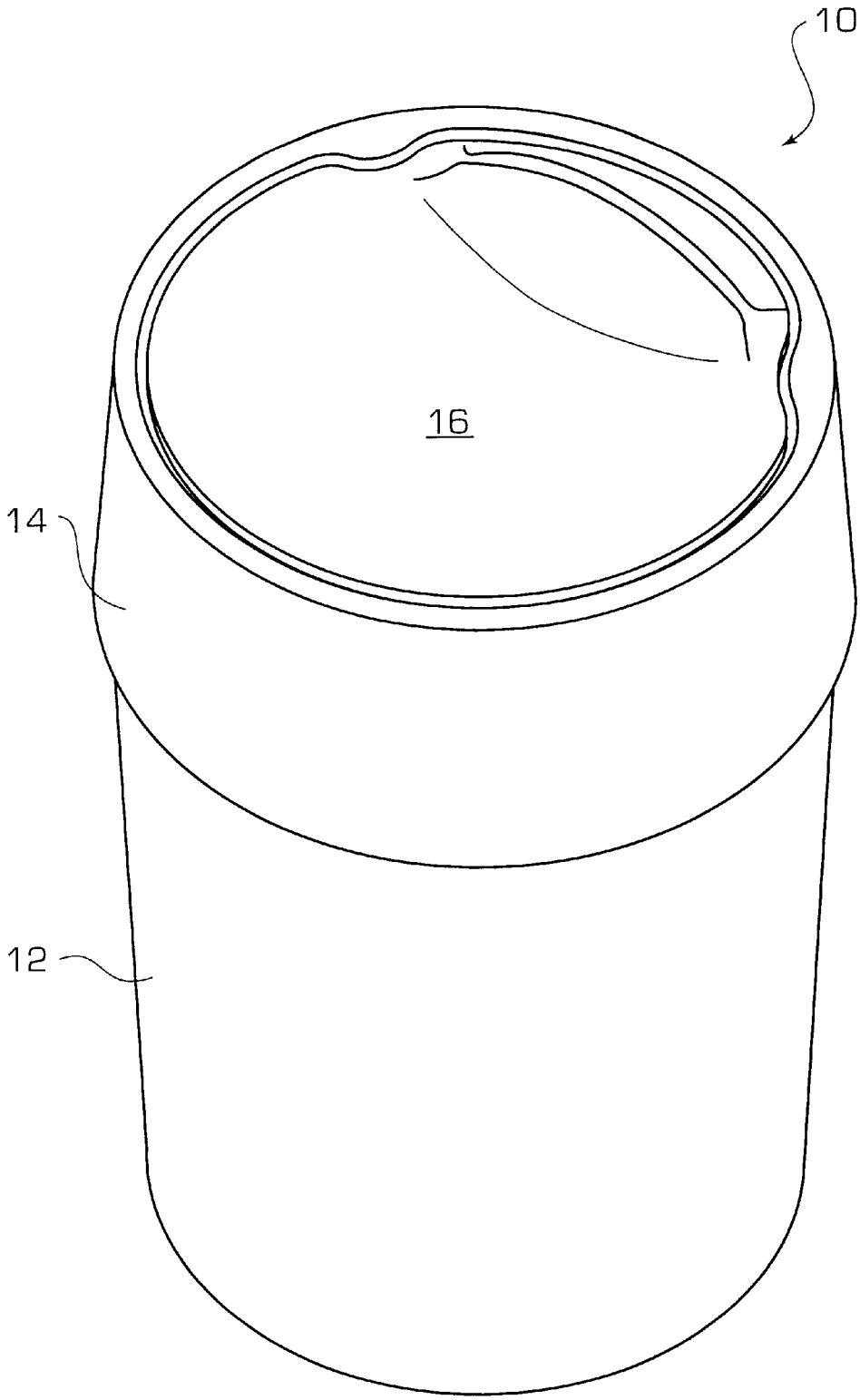
FIG. 1 is a perspective view that illustrates a preferred embodiment of the present invention.

Referring now to the drawings, wherein like reference numerals represent identical or corresponding parts throughout the several views, and more particularly to FIG. 1, a preferred embodiment of the present invention is shown in its quiescent state, namely, with cover 10 attached to and covering a waste can 12. Cover 10 comprises a collar 14, a lid 16, and a spring link 18 (not shown in this view). Waste can 12 is any standard receptacle adapted to frictionally receive cover 10 thereon.

Figure 2:
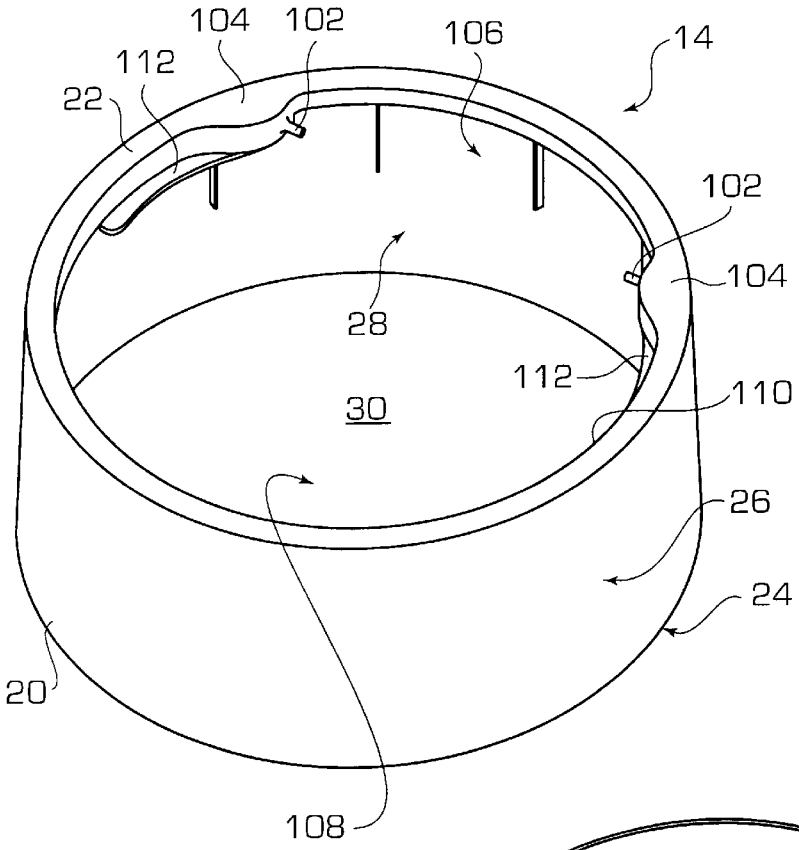
FIG. 2 is a perspective top view of the collar of the preferred embodiment of FIG. 1.
Figure 3:
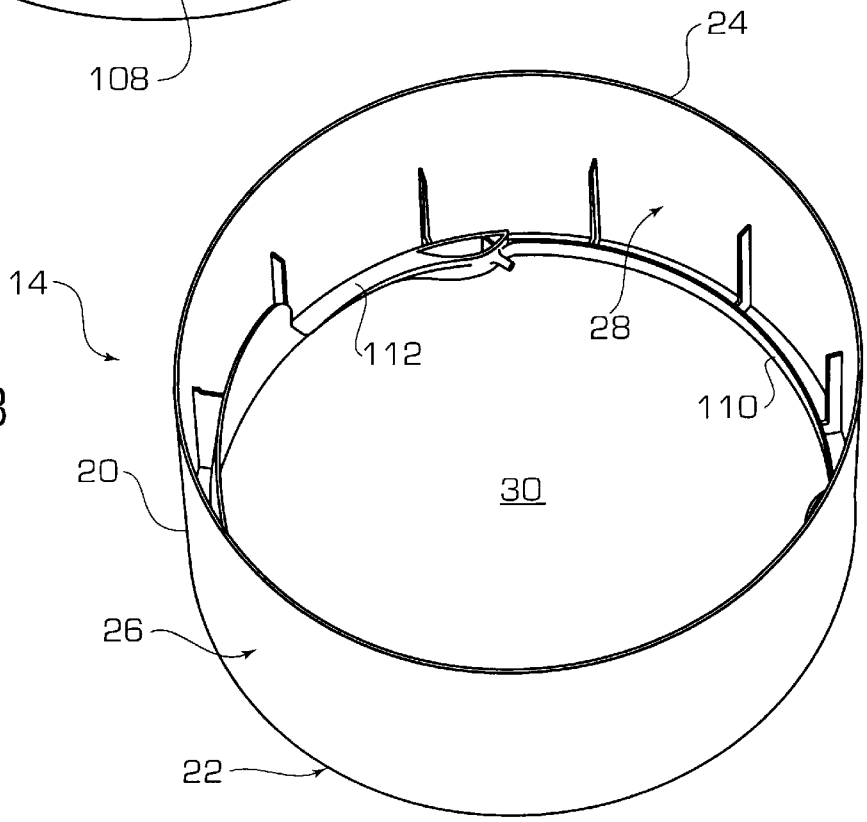
FIG. 3 is a perspective bottom view of the collar of FIG. 2.

Referring now to FIGS. 2 and 3, collar 14 comprises an annular ring 20 integrally molded of a synthetic material, preferably plastic. Ring 20 comprises a circular top edge 22, a circular bottom edge 24, a smooth outer surface 26, and an irregular inner surface 28. The individual features of irregular inner surface 28 will be discussed as their functions are introduced. Ring 20 flares slightly conically outwardly from top edge 22 to bottom edge 24 to aid in frictionally attaching it to waste can 12. Ring 20 encloses a large opening 30 within which lid 16 and link 18 operate.

Figure 4:
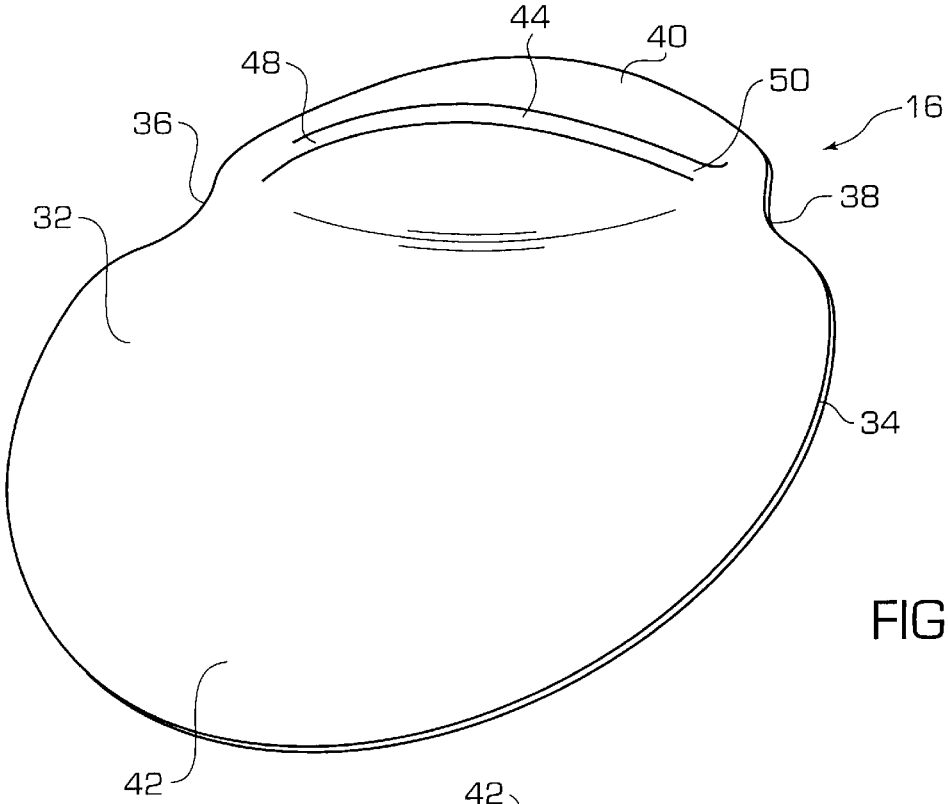
FIG. 4 is a perspective top view of the lid of the preferred embodiment of FIG. 1.
Figure 5:
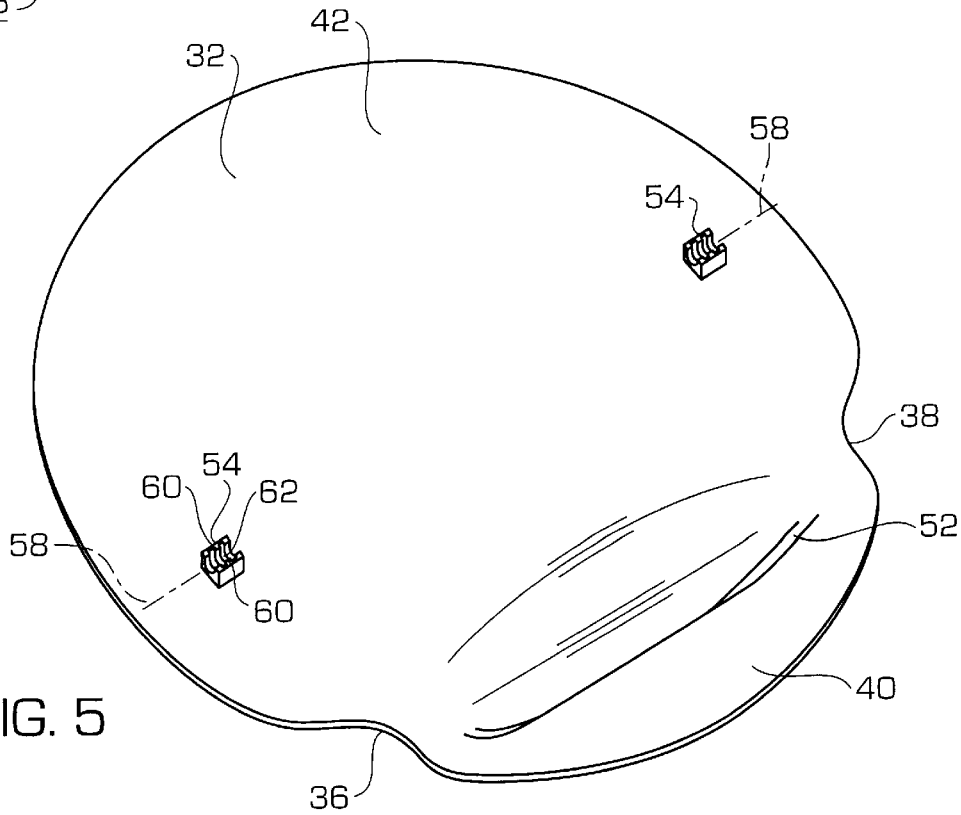
FIG. 5 is a perspective bottom view of the lid of FIG. 4.

Referring now to FIGS. 4 and 5, lid 16 is preferably integrally molded of the same material as collar 14 and comprises a sheet 32 having an asymmetrical perimeter 34 which is substantially circular but interrupted by two symmetrically positioned indentations 36 and 38. The diameter of sheet 32 is slightly less than the diameter of circular top edge 22 of collar 14. Indentations 36 and 38 divide lid 16 into two lobes, a smaller lobe 40 and a larger lobe 42. Sheet 32 is slightly concave, when viewed from above as in FIGS. 4 and 8, with an upwardly projecting tab 44 arching above its top surface 46. Tab 44 is transversely arcuate with its ends 48 and 50 terminating adjacent indentations 36 and 38, respectively. The molding of tab 44 results in an arcuate recess 52 in the lower surface 56 of lid 16. A pair of fixed bushings 54 are molded onto lower surface 56. Bushings 54 share a common axis 58 that traverses sheet 32 substantially parallel to tab 44. Bushings 54 preferably comprise two sets of parallel teeth 60 which are spaced apart by a gap 62 and which resiliently separate far enough that a spindle can be snapped into each of the bushings 54 for rotation therewithin.

Figure 6:
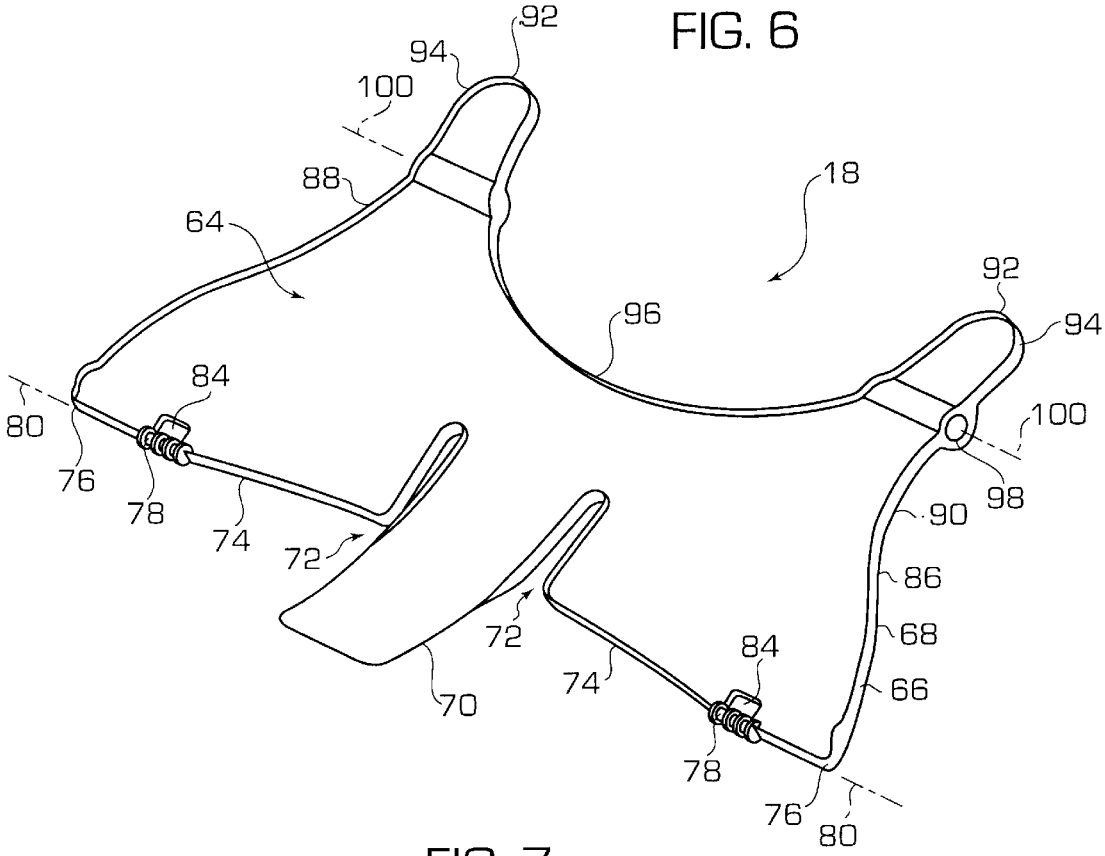
FIG. 6 is a perspective bottom view of the spring link of the preferred embodiment of FIG. 1.
Figure 7:
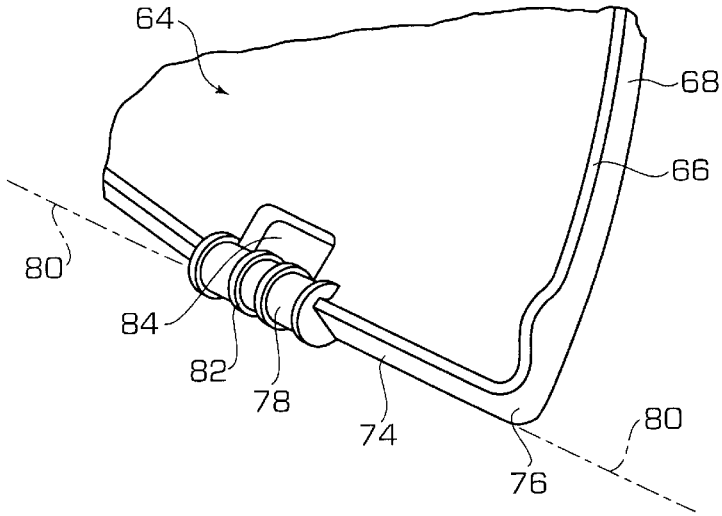
FIG. 7 is an enlarged perspective view of a fulcrum for the lid on the spring link of FIG. 6.

Referring now to FIGS. 6 and 7, spring link 18 is preferably integrally molded of the same material as collar 14 and lid 16 and comprises a substantially flat body 64 having a peripheral rib 66 for reinforcing its perimeter 68. A spring finger 70 extends from body 64 and curves downwardly (as seen when lid 16 is in its rest position of FIG. 8) relative to the plane of body 64. A pair of slots 72 bordering spring finger 70 serve to increase its length and local flexibility.

A pair of front edges 74 extend outwardly from slots 72 to a pair of corners 76. Corners 76 define the maximum width of body 64, which width is slightly less than the diameter of lid 16. Molded into front edges 74 are a pair of cylindrical spindles 78. Spindles 78 share a common axis 80 that substantially bisects spring finger 70. Spindles 78 are spaced apart the same distance as bushings 54 of lid 16. A plurality of parallel ribs 82 are integrally molded with spindles 78 and are spaced to interleave with teeth 60 of bushings 54, so that when snapped together, ribs 82 and teeth 60 coact to prevent axial movement between lid 16 and spring link 18. A pair of apertures 84 formed adjacent spindles 78 through flat body 64 of spring link 18 allows relative rotation of teeth 60 around spindles 78.

Side edges 86 of body 64 of spring link 18 converge toward each other until they reverse directions at indentations 88 and 90 where they flare slightly outwardly to the tips 92 of arms 94. The linear distance between indentations 88 and 90 are slightly less than the linear distance between indentations 36 and 38 (FIG. 4) of lid 16. Arms 94 are separated by a deep, arcuate cove 96. A pair of cylindrical bearings 98 which share a common axis 100 are formed about midway between tips 92 and indentations 88 and 90. Axis 100 is parallel to axis 80. The relative dimensions of spring link 18 and lid 16 ensures that spring link 18 will be hidden beneath lid 16 when viewed normally from outside cover 10.

The assembly and operation of cover 10 will now be described.

Spring link 18 is pivotally mounted on collar 14 by trunnions 102 (FIGS. 2–3) being journalled in bearings 98, at which point trunnions 102 are coaxial with axis 100. Trunnions 102 extend inwardly from protuberances 104 adjacent top edge 22 on the inner surface 28 of collar 14. Protuberances 104 divide circular opening 30 into two lobes, a smaller lobe 106 and a larger lobe 108, giving opening 30 an internal periphery 110 which is congruent to periphery 34 of lid 16.

Figure 8:
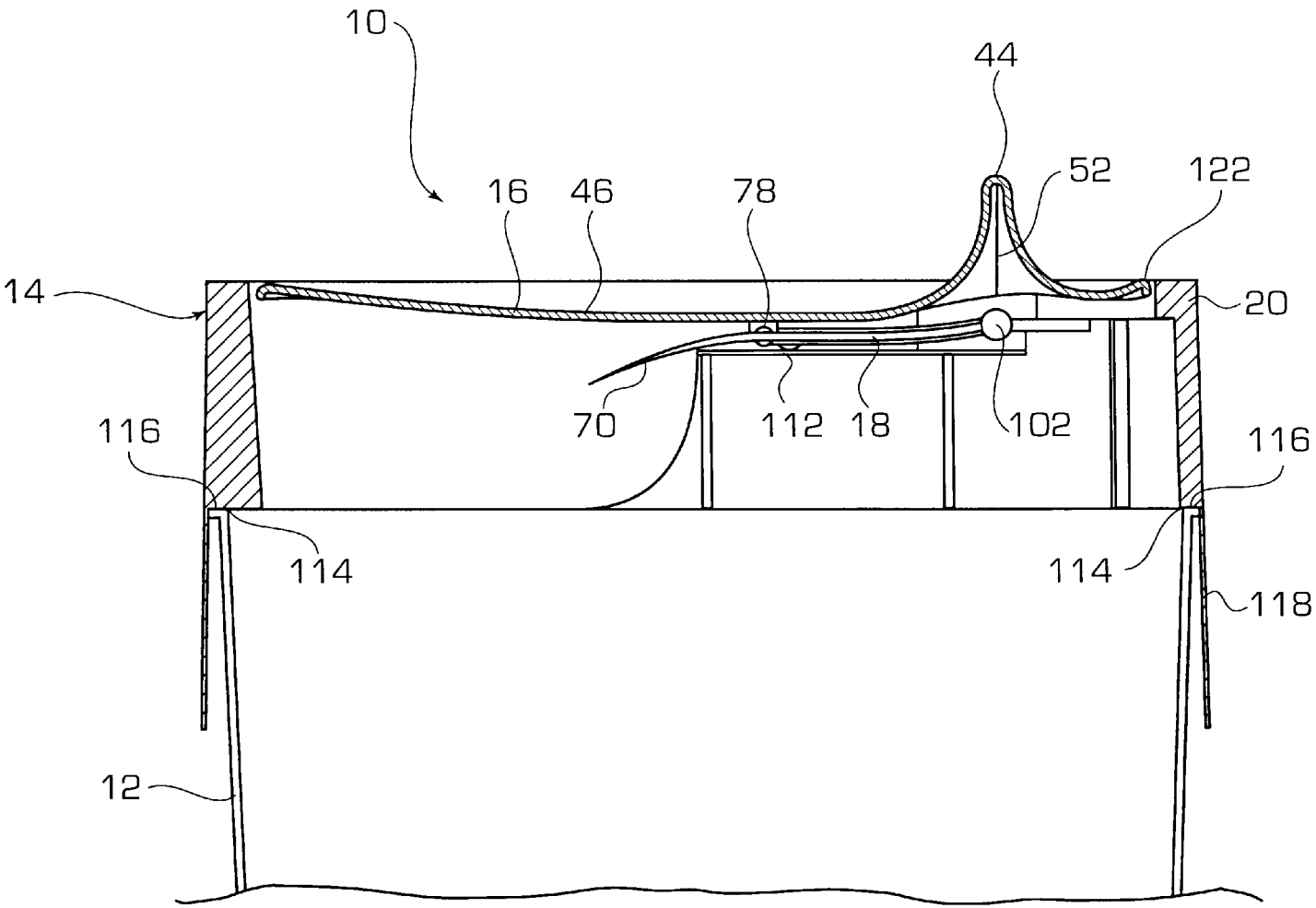
FIG. 8 is a side, cross-sectional view of the preferred embodiment of FIG. 1 with the lid closed.

Arms 94 of spring link 18 extend into smaller lobe 106 of collar 14, while spring finger 70 of link 18 extends approximately half way across opening 30 of collar 14, as perhaps best seen in FIG. 8. The weight distribution is such that if left to gravitational forces alone, arms 94 would not be enough to prevent body 64 from pivoting spring link 18 counter-clockwise about axis 100 on trunnions 102. In order to prevent spring link 18 from assuming a vertical attitude, a pair of ledges 112 (FIGS. 2–3 and 8–10) are molded into inner surface 28 of collar 14 against which corners 76 of link 18 are biased by gravity to rest. Ledges 112 are spaced below top edge 22 of ring 20 a sufficient distance such that lid 16 is properly oriented within collar 14 for closing opening 30 when lid 16 and spring link 18 are resting thereon. Spring link 18 is attached with spring finger 70 pointing downwardly (FIG. 8).

Figure 9:
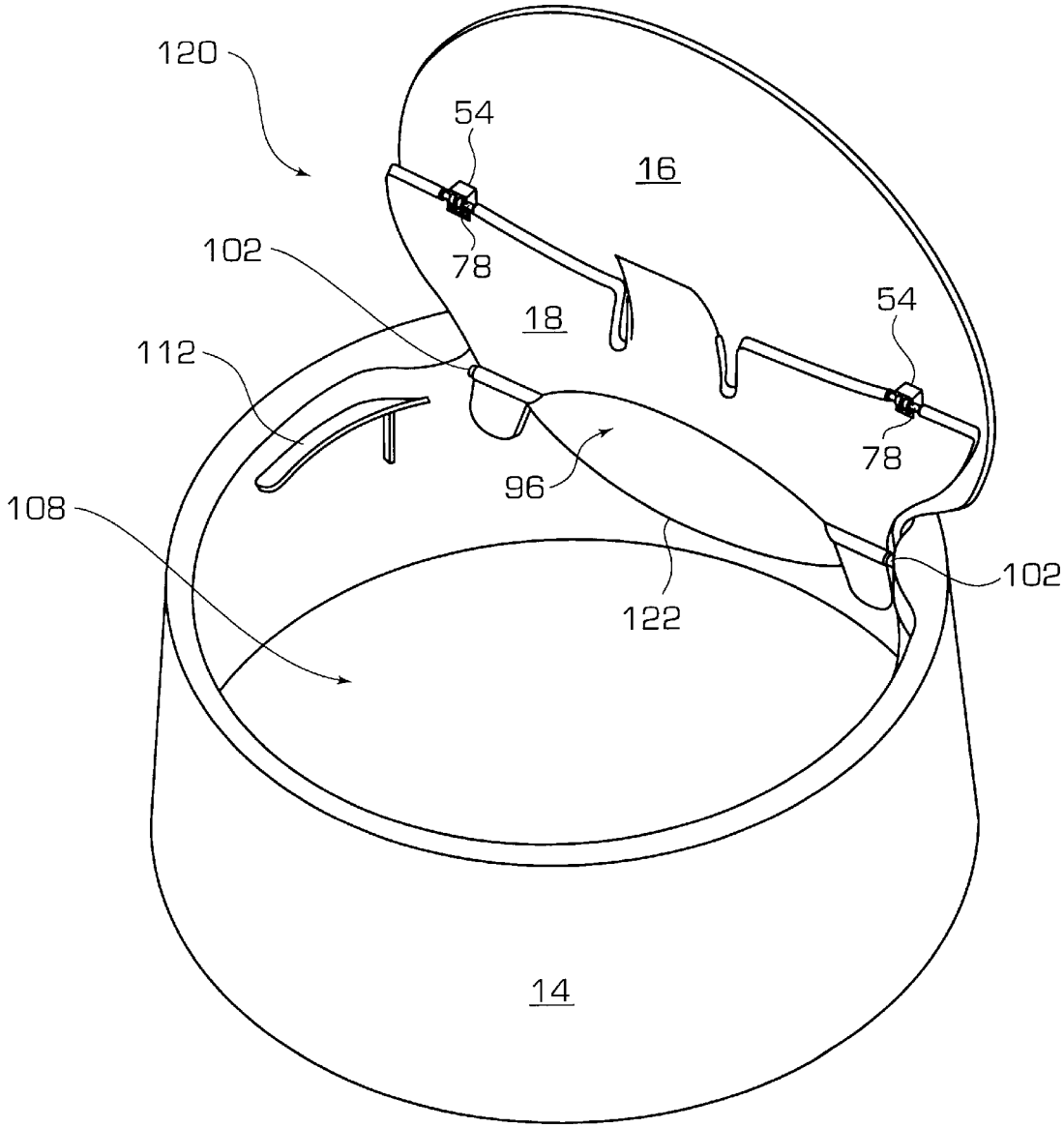
FIG. 9 is a perspective view of the preferred embodiment of FIG. 1 with the lid opened in a first position.

Lid 16 is pivotally mounted to spring link 18 by spindles 78 of spring link 18 being journalled within bushings 54 on lower surface 56 of lid 16 (see also FIG. 9). Axes 58 and 80 are now coincident. The spring and/or gravitational forces acting on lid 16 rotationally bias it into a parallel orientation to spring link 18 when at rest, as best seen in FIG. 8 which shows a cross-section of cover 10 and waste can 12 in the quiescent state.

Referring still to FIG. 8, collar 14 has an annular shoulder 114 that rests on the annular upper lip 116 of waste can 12. This arrangement maximizes the diameter of opening 30 relative to the opening into waste can 12. An apron 118 depends from annular ring 20 to guide cover 10 into proper alignment with lip 1 16. Apron 118 hides any overlap by lip 116 of a plastic liner (not shown) which may be placed inside waste can 12. Collar 14 is merely friction fit over lip 116, as shown. Spring link 18 is biased by gravity counter-clockwise (as viewed in FIG. 8) about trunnion 102 and rests on ledge 112. Lid 16 is biased clockwise about spindles 78 and rests on spring link 18. Note that lid 16 and link 18 are substantially parallel.

Figure 10:
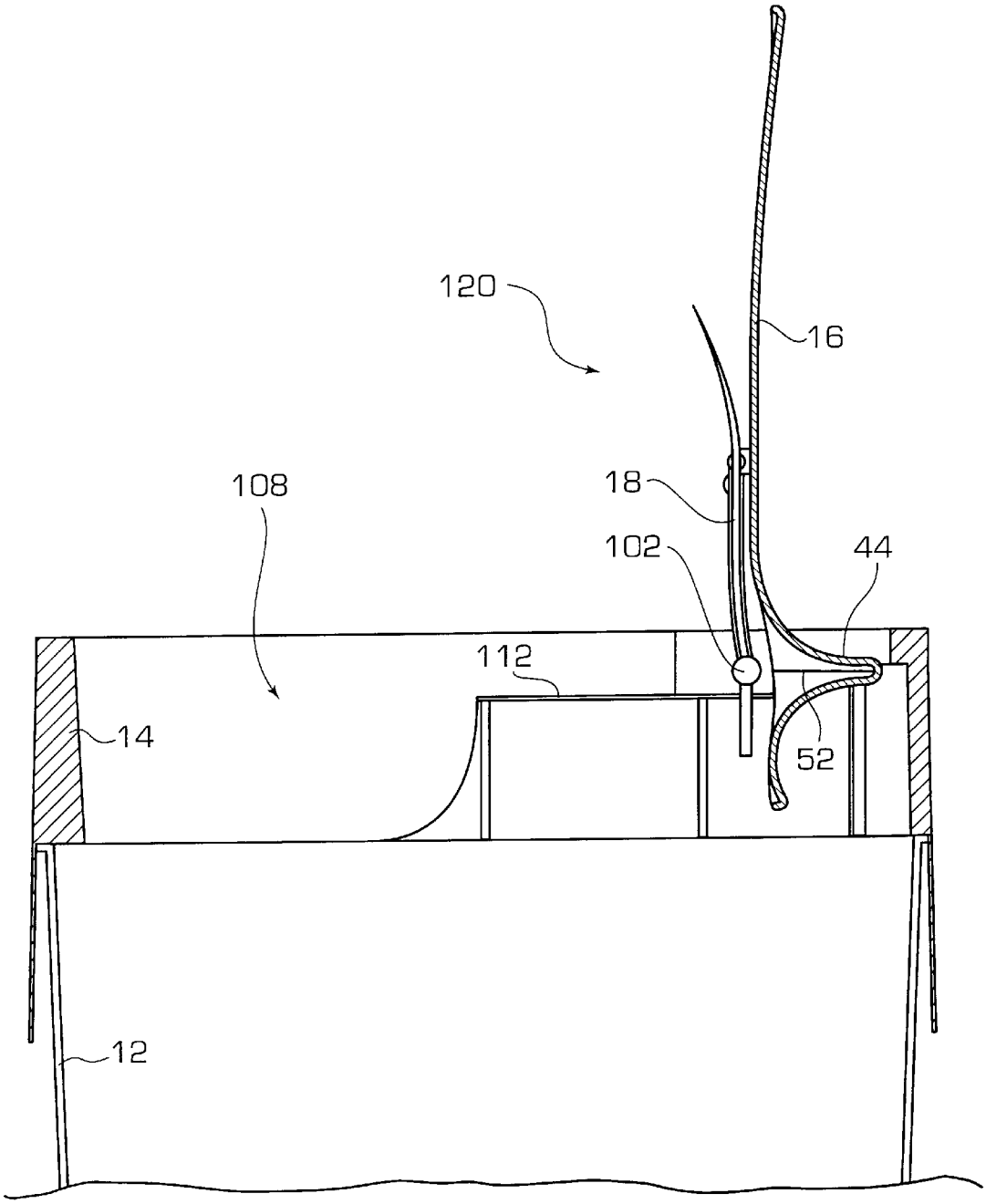
FIG. 10 is a side, cross-sectional view of the present invention with the lid opened in the first position of FIG. 9.

FIGS. 9 and 10 show, in a perspective view and a side, cross-sectional view, respectively, lid 16 opened in a first position referred to as "backward tilt". A user has pushed on tab 44 to rotate the assemblage 120 comprising lid 16 and spring link 18 as a unit about trunnions 102. In this position, larger lobe 108 of opening 30 is open inasmuch as lid 16 and spring link 18 have been removed therefrom. In the position shown, the center of gravity of assemblage 1 20 is located to the rear of trunnions 102. Thus, assemblage 120 will remain in the position shown, until a force is applied to return assemblage 120 to the quiescent state of FIG. 8. Lid 16 and link 18 are still substantially parallel.

Figure 11:
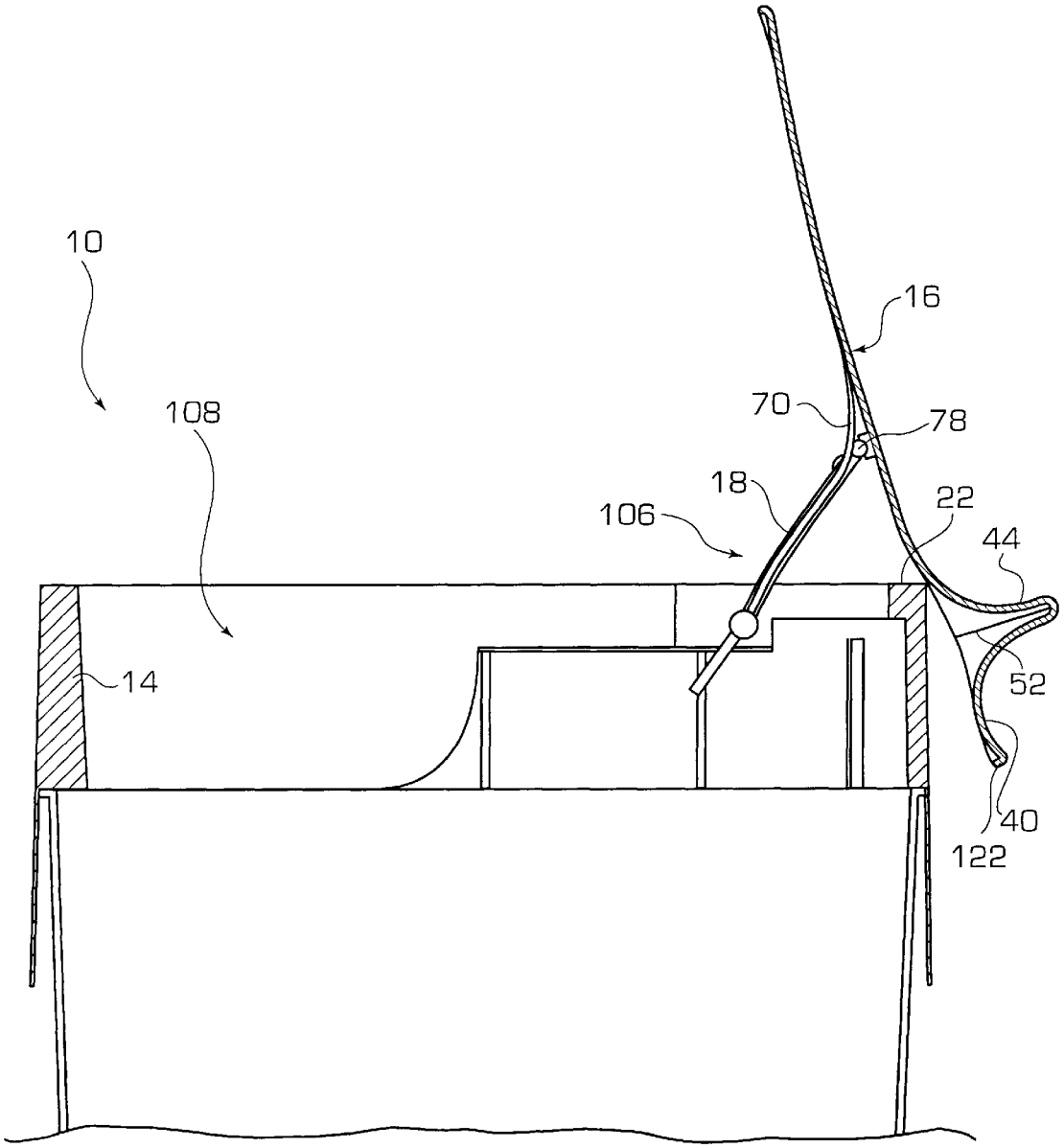
FIG. 11 is a side, cross-sectional view of the preferred embodiment of FIG. 1 with the lid opened in a second position.

FIG. 11 is a side, cross-sectional view of cover 10 with lid 16 opened in a second position referred to as "backward tilt with lock". To reach this position, a user has grasped tab 44 (from the position shown in FIG. 8) and rotated lid 16 counter-clockwise about spindles 78. Cove 96 (FIG. 9) permits easy access to edge 122 for this maneuver. In this position lobe 108 is completely open and lobe 106 is almost completely open, access thereto being available through cove 96 between arms 94. Spring finger 70 is deflected and continuously applies a biasing force against lid 16 trying to rotate it back to being parallel with spring link 18. To prevent this, smaller lobe 40 of lid 16 has been hooked over top edge 22 of collar 14, where the bias of spring finger 70 now locks lid 16 in place.

Figure 12:
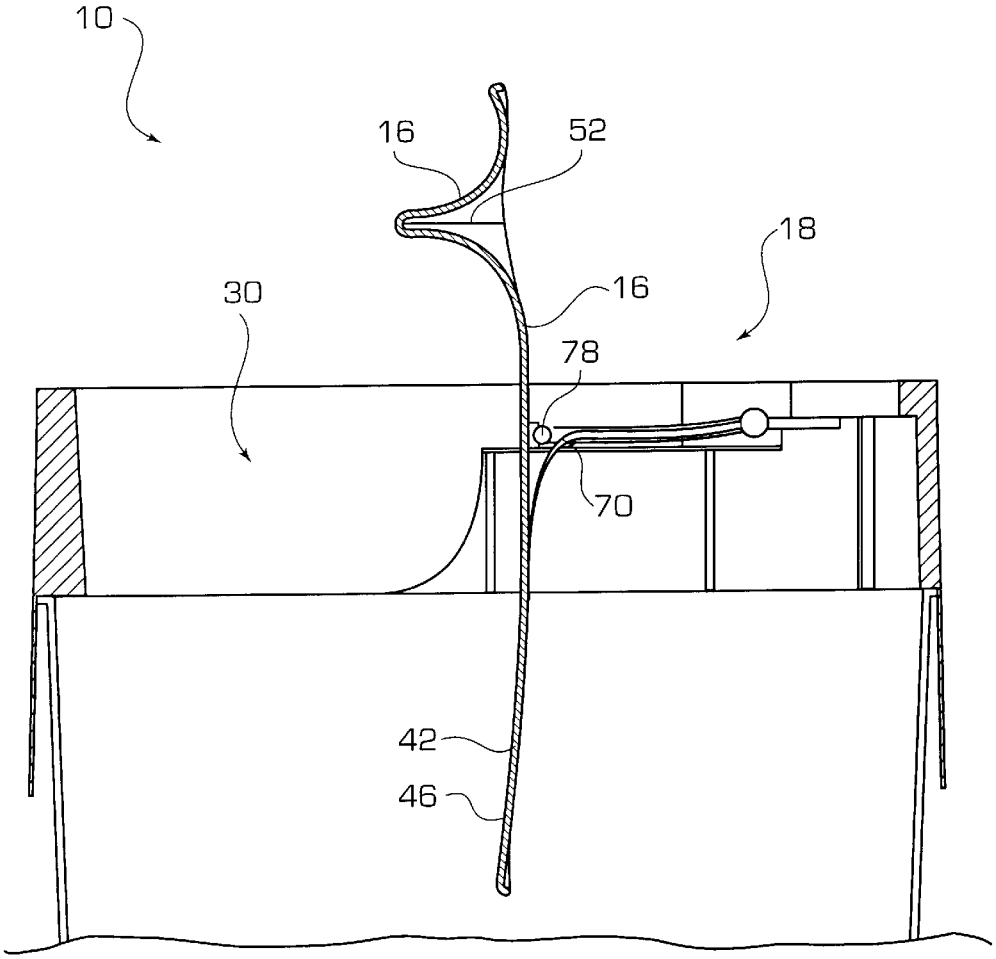
FIG. 12 is a side, cross-sectional view of the preferred embodiment of FIG. 1 with the lid opened in a third position.

FIG. 12 is a side, cross-sectional view of cover 10 with the lid opened in a third position referred to as "forward tilt". Beginning with the quiescent state of FIG. 8, a downward pressure on top surface 46 of lid 16 somewhere in larger lobe 42 will rotate lid 16 counter-clockwise about spindles 78 against the bias of spring finger 70 to open cover 10, as shown in FIG. 12. In this position, opening 30 is essentially only half opened, the other half being blocked by spring link 18. When the downward pressure is released, spring finger 70 will return lid 16 to its quiescent state, and waste can 12 will again be closed.

It will be appreciated by one skilled in the art that cover 10 comprises only three elements: a collar; a lid; and a spring link, so-named because it functions both as a linkage between the collar and lid and a spring which biases the lid closed. Three modes of operation are made possible by the pivot axis between lid and link being spaced apart and parallel relative to the pivot axis between link and collar.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U.S. Pat. and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim as my invention:

1. A cover for covering a receptacle, comprising:

a collar adapted to fit said receptacle, said collar having an opening therethrough;

a spring link pivotally attached to said collar along a first axis; and a lid pivotally attached to said spring link along a second axis, said first and second axes being spaced apart and parallel.

2. The cover of claim 1 wherein said receptacle has an upper annular surface and said collar includes an inner surface with a ledge thereon and said spring link is biased to a rest position on said ledge substantially parallel to said upper surface.

3. The cover of claim 2 wherein said lid is biased to a rest position parallel with said spring link.

4. The cover of claim 1 wherein said lid is capable of first, second and third distinct operating modes.

5. The cover of claim 4 wherein in said first operating mode, said collar opening is substantially half closed.

6. The cover of claim 5, wherein in said second operating mode, said collar opening is substantially fully open.

7. The cover of claim 6, wherein in said third operating mode, said collar opening is open an amount intermediate said first and second operating modes.

8. The cover of claim 6, wherein said lid is locked open when said lid is in said second operating mode.

9. The cover of claim 1, wherein said collar includes an inner surface, and said spring link comprises a pair of arms pivotally mounted to said inner surface of said collar.

10. The cover of claim 9, wherein said spring link further includes a front edge that is pivotally attached to said lid.

11. The cover of claim 10, wherein said spring link further comprises a spring component that extends beyond said front edge.

12. A cover for covering a receptacle having a peripheral rim, comprising:

an annular collar adapted to fit upon said peripheral rim of said receptacle, said collar having an inner surface and an opening therethrough;

a spring link having a front edge, a spring component extending beyond said front edge, and a pair of arms extending rearwardly from said front edge, said arms being pivotally mounted to said inner surface of said collar along a first axis;

a lid pivotally attached to said front edge of said spring link along a second axis, said first and second axes being spaced apart and parallel, said spring component not contacting said lid in repose.

13. The cover of claim 12, wherein said lid is capable of first, second and third distinct operating modes.

14. The cover of claim 13, wherein in said first operating mode, said collar opening is substantially half closed.

15. The cover of claim 14, wherein in said second operating mode, said collar opening is substantially fully open.

16. The cover of claim 15, wherein in said third operating mode, said collar opening is open an amount intermediate said first and second operating modes.

17. The cover of claim 15, wherein said lid is locked open when said lid is in said second operating mode.

18. A cover for covering a receptacle having a peripheral rim, comprising:

a collar adapted to fit upon said peripheral rim of said receptacle, said collar having an opening therethrough;

a spring link having a spring component extending in a first direction, and a pair of arms extending in a second direction opposite to said first direction, said arms being pivotally mounted to said collar along a first axis;

a lid pivotally attached to said spring link along a second axis, said first and second axes being spaced apart and parallel, said spring component not contacting said lid in repose.

19. The cover as in claim 18, wherein said lid can be operated in three distinct modes, a first mode in which said collar opening is substantially half closed, a second mode in which said collar opening is substantially fully open, and a third mode in which said collar opening is intermediate said first and second modes.

20. The cover as in claim 19, wherein said spring component does not contact said lid in said first mode, but contacts said lid in said second and third modes.

* * * * *